US006488496B1

(12) United States Patent
Feese et al.

(10) Patent No.: US 6,488,496 B1
(45) Date of Patent: Dec. 3, 2002

(54) COMPACT COMBINATION BURNER WITH ADJUSTABLE SPIN SECTION

(75) Inventors: James J. Feese, Elizabethtown, PA (US); Raymond F. Baum, Lebanon, PA (US); Edward E. Moore, Hummelstown, PA (US); Bruce C. Irwin, Chattanooga, TN (US)

(73) Assignee: Hauck Manufacturing Co., Lebanon, PA (US)

( * ) Notice: Subject to any disclaimer, the term of this patent is extended or adjusted under 35 U.S.C. 154(b) by 0 days.

(21) Appl. No.: 09/946,598

(22) Filed: Sep. 6, 2001

(51) Int. Cl.[7] ..... F23Q 9/00

(52) U.S. Cl. ..... 431/285; 431/115; 431/182; 431/188; 431/284

(58) Field of Search ..... 431/182, 183, 431/285, 284, 187, 181, 279, 188, 189, 115, 116, 352, 350

(56) References Cited

U.S. PATENT DOCUMENTS 4,748,919 A * 6/1988 Campobenedetto et al. 431/284
4,815,966 A * 3/1989 Janssen ..... 431/285
5,192,204 A * 3/1993 Musil ..... 431/183
5,259,755 A * 11/1993 Irwin et al. ..... 431/285
5,511,970 A * 4/1996 Irwin et al. ..... 431/285
5,807,094 A * 9/1998 Sarv ..... 431/284

* cited by examiner

*Primary Examiner*—James C. Yeung
(74) *Attorney, Agent, or Firm*—Jonathan P. Miller; McNees Wallace & Nurick LLC

(57) ABSTRACT

A combination burner for selectively firing oil, natural gas and liquid propane. A modular first section has primary and secondary air tubes coaxially arranged therein and communicates with the main combustion air supply fan. A modular section is joined by bolts or the like to the first section and into which the primary and secondary air tubes extend. A center air spin vane rack is upstream of the secondary air tube in the first section. An adjustable spin vane rack is located radially outwardly of the secondary air tube for selectively spinning the main combustion air for flame adjustability. An air diverter is provided at a downstream end of the primary air tube. A compressed air atomizer is also at the downstream end of the primary air tube.

14 Claims, 5 Drawing Sheets

COMPACT COMBINATION BURNER WITH ADJUSTABLE SPIN SECTION

BACKGROUND OF THE INVENTION

The present invention relates to a lower cost, higher efficiency combination burner which fires on natural gas, fuel oil and liquid propane gas with lower CO emissions and high flame stability.

Conventional combination burners such as shown, for example, in U.S. Pat. Nos. 5,259,755 and 5,700,143, assigned to the assignee of the present application, experience one or more of the following conditions:

(1) high CO and unburned hydrocarbon emission;

(2) inadequate flame shaping to match the size of the available combustion space;

(3) low efficiency;

(4) flame instability oil when using compressed air atomization;

(5) bulky burners package size.

These shortcomings have long been known in the combustion industry but efforts by various sources to overcome them in one burner have been unsuccessful. For example, the "ECOSTAR" burner made by the Hauck Manufacturing Company, said assignee, achieved natural gas stability with an enlarged flame holding area but did not achieve other desired goals.

SUMMARY OF THE INVENTION

An object of the present invention has been to solve the problems and shortcomings encountered in conventional combination burners.

This object has been achieved by providing a combination burner of the general type shown in the above-referenced U.S. patents, whose disclosure is incorporated by reference herein, but in which a compact burner unit is configured with an adjustable and highly efficient spin section in the burner nose so as to provide substantially improved flame adjustability.

According to another aspect of the present invention, higher static air pressures are used to promote faster air/fuel mixing in natural gas, propane and oil so as to achieve higher flame intensities and thereby smaller flame volumes.

A still further aspect of the present invention involves achieving flame stability by enlarging the flame stabilization zone when the burner is on natural gas, ahd using an atomizer and diverting air ring on the primary air tube when the burner is on oil.

More specifically, the combination burner according to the present invention achieves these advantages by being provided, inter alia, with an adjustable and energy-efficient main air spin section located in the burner nose where it has been found to be most effective; a fixed secondary air spin section in the center; a higher pressure main air supply, via main air fan, to promote high exit velocities and fast mixing for higher combustion intensity; an air diverting ring to promote flame stability and eliminate overspray on oil firing; an enlarged gas stability point for improved flame stability on natural gas; a compressed air atomizer for oil firing; and a multiple propane nozzle for firing liquid propane.

The foregoing compact combustion burner provides lower CO emissions than in conventional burners, improves flame stability on natural gas, oil and propane, achieves faster mixing to improve combustion intensity, provides better flame shaping and adjustability and allows the use of modular manufacturing techniques.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
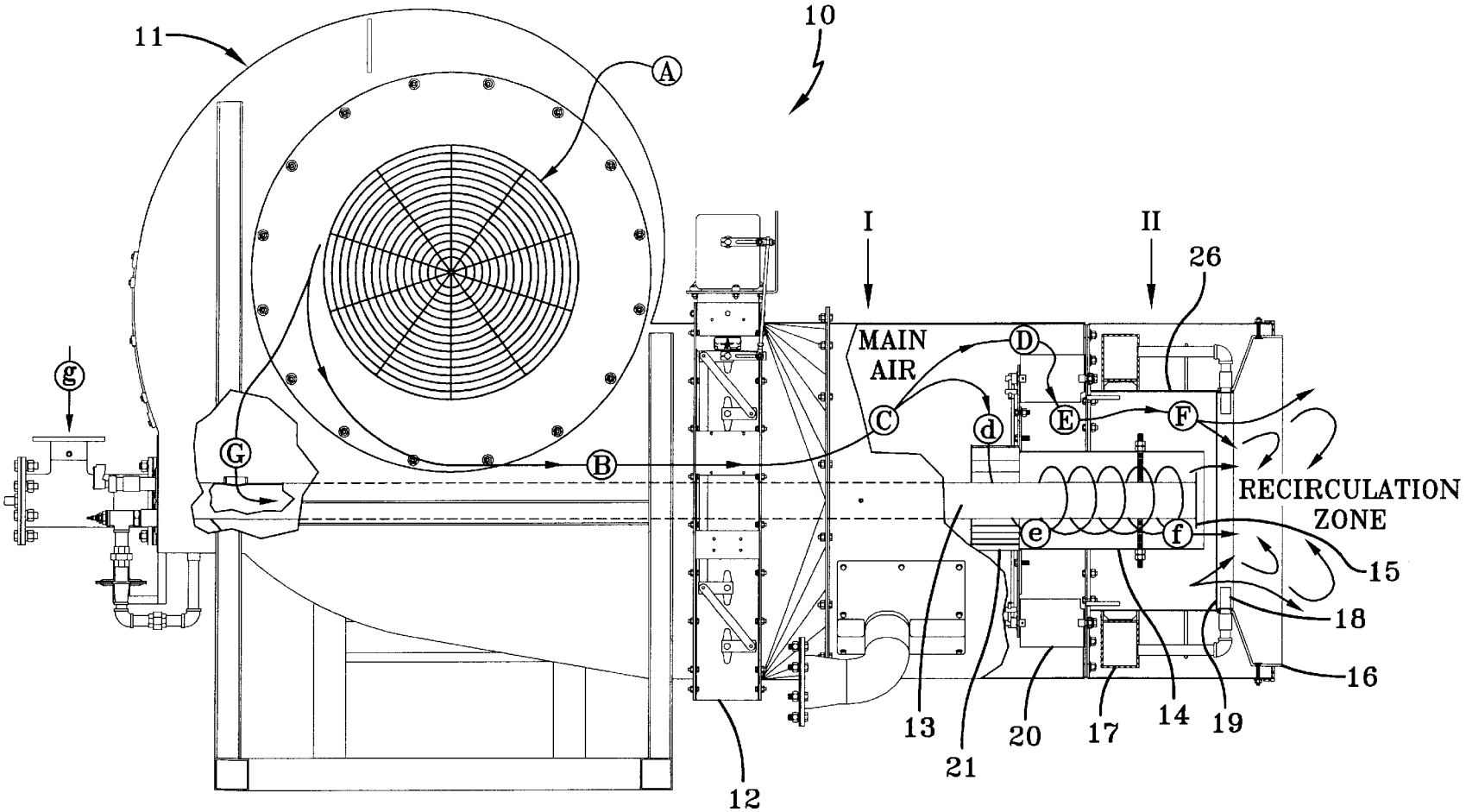
FIG. 1 is a side view of the burner according to the present invention in which the main air fan casing and burner exit area are in partial section to illustrate air flow therethrough.

Referring now to the drawings and, in particular, to FIG. 1, there is shown a combination combustion burner designated generally by the numeral 10. Certain features of such burners, such as are shown in the above-mentioned U.S. Pat. No. 5,700,143 and other combination burner prior art, are generally well known and the function thereof need not be described in greater detail, to one of ordinary skill in the burner art, such as a main air fan 11 which supplies high pressure main combustion air, an outlet damper 12, a primary air tube 13, a secondary air tube 14, a cone segment 16 arranged at the end of a tertiary air tube 26, a gas manifold 17, natural gas supply nozzles 18, and a choke ring or gutter 19.

Furthermore, the same numbers and letters have been used throughout the drawing figures to identify the identical parts and their functions as may be appropriate when firing "on oil", "on liquid propane" and "on natural gas".

The burner unit 10 shown in FIG. 1 is able to be made compact and modular by the provision of two burner sections I and II joined together in a conventional manner by being bolted or the like. The section I contains the primary air tube 13 and secondary air tube 14 surrounding the primary air tube 13 and a spin section which has an adjustable main air spin vane rack 20. The adjustable spin rack 20 in this location achieves improved flame adjustability and is located downstream of a secondary fixed air spin vane rack 21 at the inlet of the secondary air tube 14 where the adjustable spin rack 20 is the most effective. The higher pressure air supply provided by the main air fan 11 through the adjustable spin rack 20 promotes both high exit velocities and fast mixing for higher combustion intensity. The air diverter ring 15 at the downstream end of the primary tube 13 also promotes flame stability and eliminates overspray when "on oil," i.e. during oil firing of the burner 10.

The role of static air pressure in promoting faster air/fuel mixing and attaining higher flame intensities and smaller flame volumes is best seen with reference to FIG. 1. A "far field" fluid particle at rest, point A, is drawn into the main fan 11 and is elevated to a substantially higher static pressure at point B. The particle travels to point C and then either follows the path of D-E-F or alternatively d-e-f. In either case, at point D or d, the fluid particle is accelerated substantially resulting in a loss of a portion of the static pressure developed by the fan 11. From point D or d to point E or e, respectively, the particle again undergoes substantial acceleration, resulting in a further increase in the particle velocity via a reduction in static pressure. Finally, at point F or f the conversion of the remaining static pressure to fluid velocity energy is accomplished resulting in very rapid mixing of the air and respective fuel being burned. Thus, efficient conversion of static pressure to velocity is maximized resulting in enhanced air/fuel mixing which ultimately results in the desired very high combustion intensities and small flame volumes.

To further explain, the secondary airflow along points d-e-f stabilizes the flame regardless of fuel type being burned by creating a constant recirculation zone in the vicinity of the burner exit, just downstream of the primary air tube 13. A secondary air spin rack 21 imparts a constant swirl number (defined as the ratio of angular to axial momentum) to the secondary air stream equal to 1.2. This number is substantially above the critical swirl number=0.6 required to achieve a constant recirculating airflow pattern. The resulting constant secondary air recirculation zone substantially improves burner stability firing any fuel.

Figure 5A:
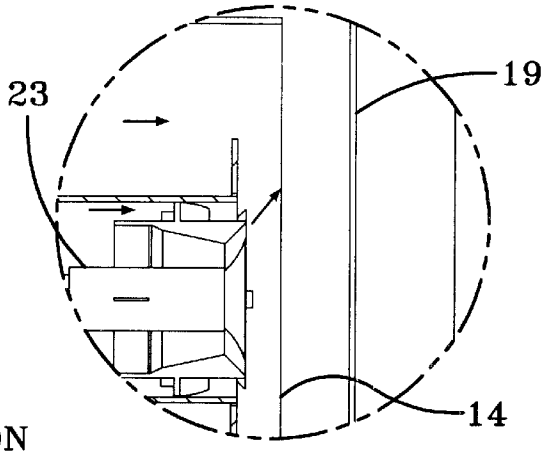
FIGS. 5 and 5A are, respectively, an enlarged partial sectional view of the burner of FIG. 1 when firing "on oil" and a further enlarged view of the oil atomizer in the circular area of FIG. 5.
Figure 5:
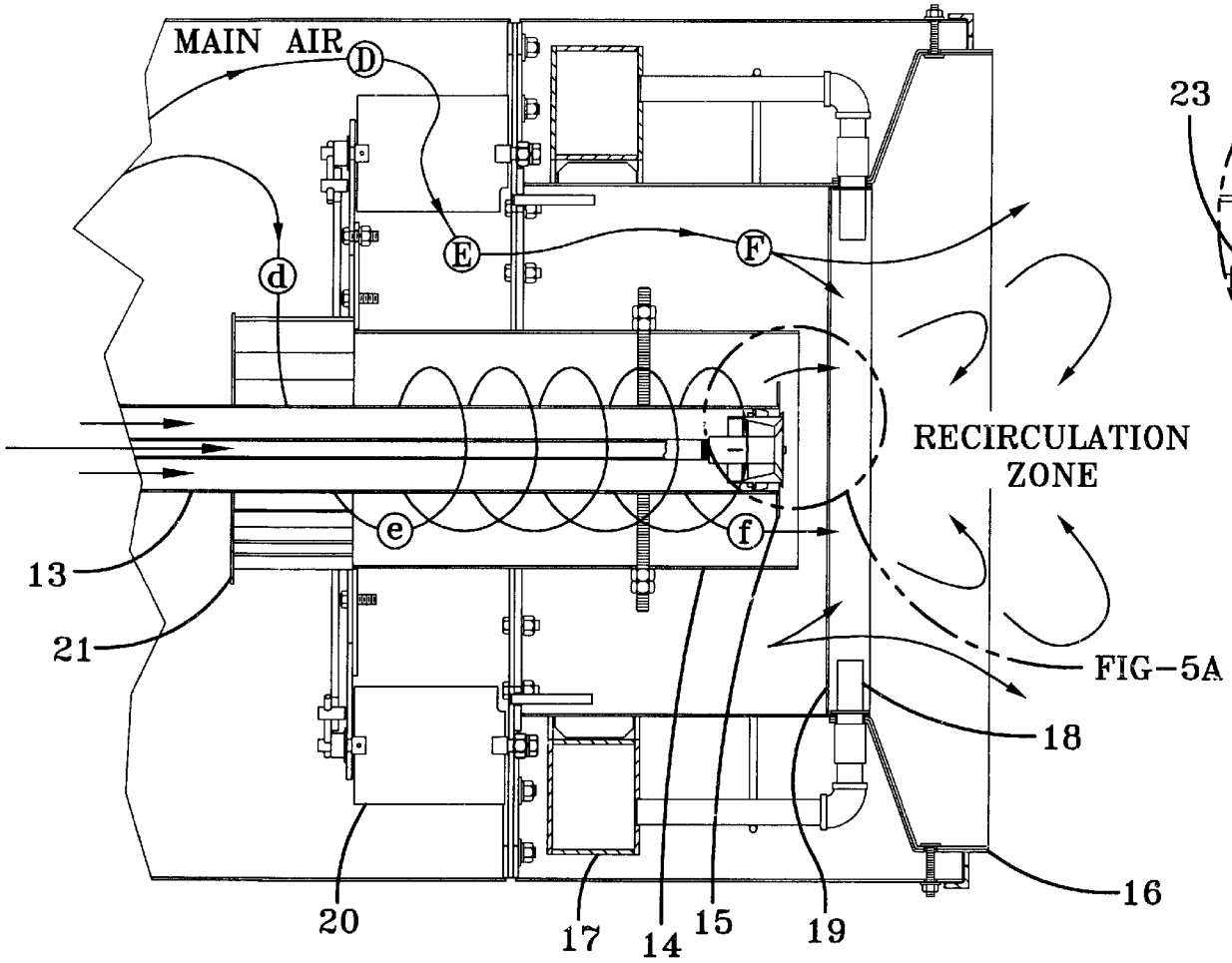

Two different oil atomizes can be used. The first type is a low pressure atomizer 23 (FIGS. 5 and 5A) which utilizes low pressure air (primary air) supplied at approximately 36 osig via a separate blower (not shown) connected at gas shown in FIG. 1. Firing with the low pressure atomizer as used in FIGS. 1 and 5 requires the bleed hole at G (shown in FIG. 1) be closed.

Figure 2A:
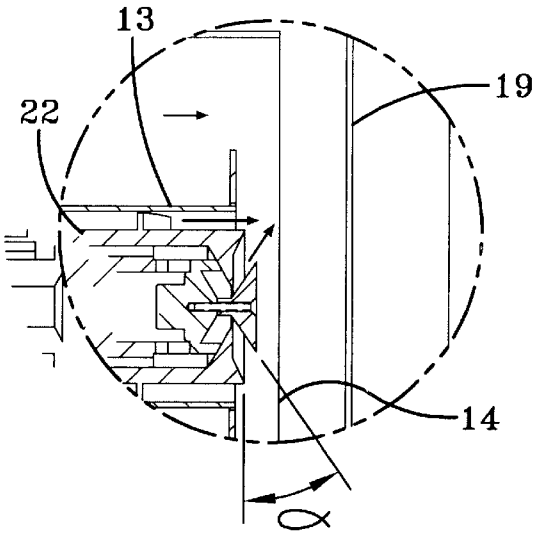
FIGS. 2 and 2A are, respectively, an enlarged partial side sectional view of the modular combination burner of the present invention shown in FIG. 1 without the presence of the liquid propane nozzles and a further enlarged isolated view of the compressed air atomizer at the end of the primary air tube.
Figure 2:
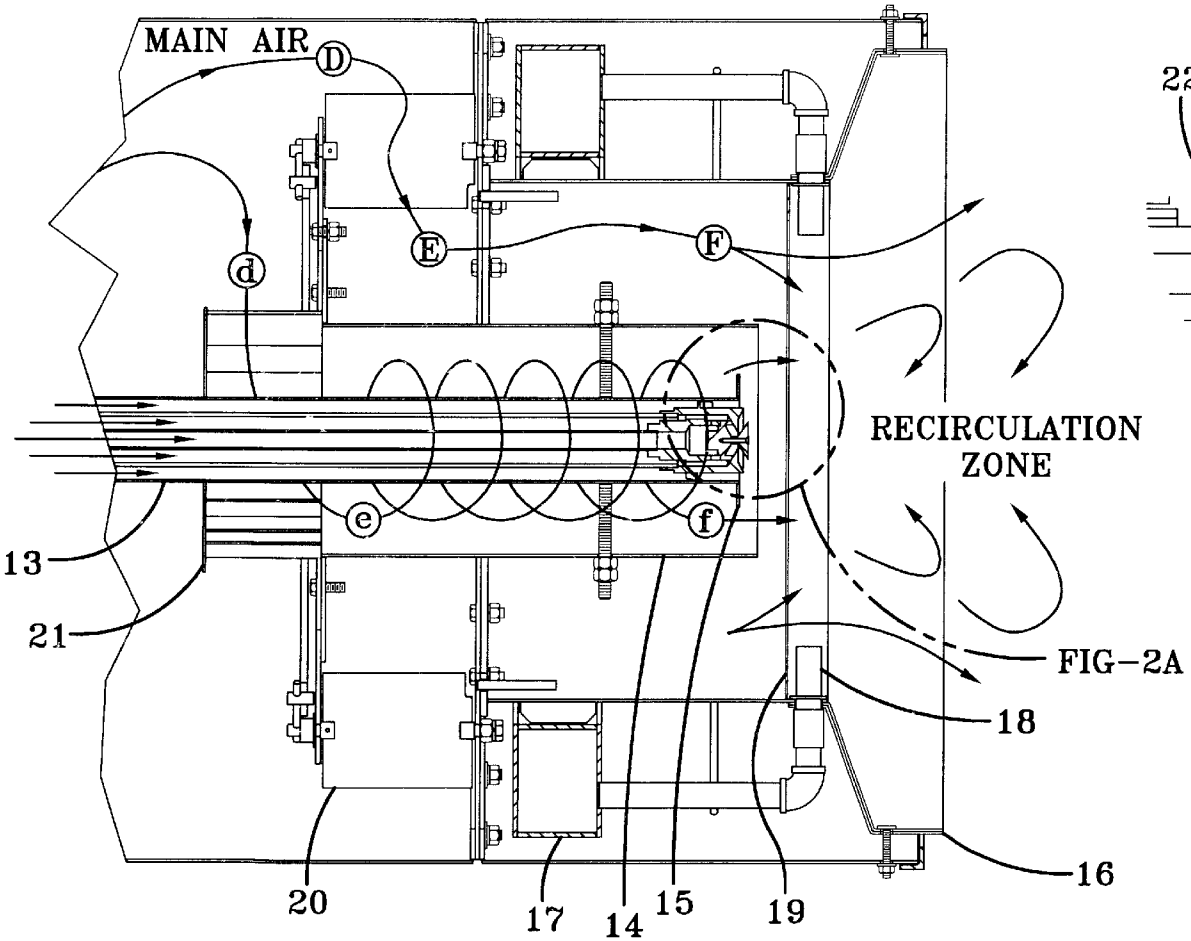

The second type is a compressed air atomizer, which utilizes compressed air supplied at a nominal 60 psig, to atomize the liquid fuel oil (as seen in FIGS. 2 and 2A). In the compressed air atomizer, low pressure primary air is also introduced into the primary air tube at location G via the main air fan 11 as shown in FIG. 1. A separate blower is not required. When firing with the compressed air atomizer, the low pressure primary air supplied at G helps to eliminate large fuel oil droplets or overspray from escaping the flame. The primary air flow, taken directly from the main air fan, is also spinning with a fixed swirl number equal to 0.9 and further contributes to the low pressure stability zone and elimination of large droplets of oil overspray. The angle of divergence $\alpha$ (FIG. 2A) of the compressed air nozzle tip, is critical in establishing a stable oil flame. The range of $\alpha$ should be 20 to 35°.

The relative location of the oil atomizer(s) with relation to the primary air tube 1, secondary air tube 14, and choke ring gutter 19 are critical in insuring both flame stability and the minimization of "overspray" or large fuel oil droplets which may escape the flame unburned. As seen in both FIGS. 2A and 5A, the atomizer 22, 23 is located 3/16" forward of the primary air tube 13. The primary air tube 13 is located 1" behind the secondary air tube 14, and the downstream end is located 1½" behind (or upstream) of the choke ring gutter 19.

Furthermore, the air diverter ring 15 located on the very end of the primary air tube 13 serves the critical purpose of diverting the center of secondary air outward from the base of the atomized oil spray, thereby enhancing burner stability on oil firing and capturing the overspray and driving it back into the main flame to maximize oil burnout. The diverging tip, or pintle of the atomizer effectively deflects the atomized oil spray away from the burner centerline working in conjunction with the above-described secondary airflow to create a low pressure and self-recirculating stability zone just downstream of the atomizer 22.

Figure 3A:
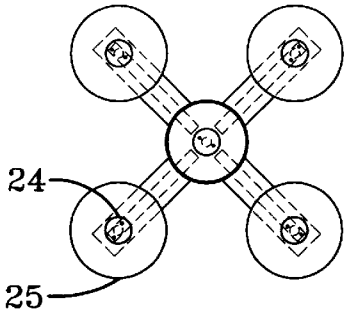
FIGS. 3, 3A and 3B are, respectively, an enlarged exhaust end view of the burner of FIG. 1 but with liquid propane nozzles located at the end of the primary air tube when firing "on liquid propane" (LP), an isolated view of the liquid propane (LP) nozzles and associated deflector plates as seen in the directions of A—A in FIG. 3, and a further enlarged view showing the recirculation zone in the circular area of FIG. 3.
Figure 3B:
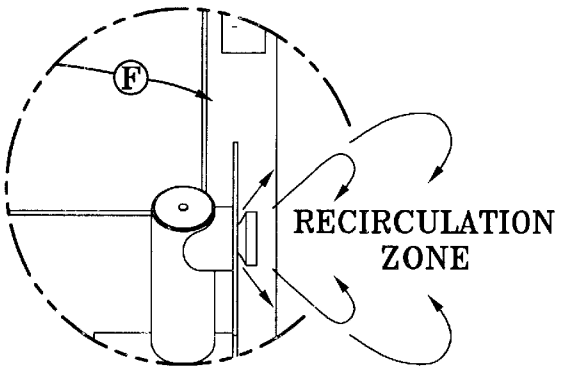
Figure 3:
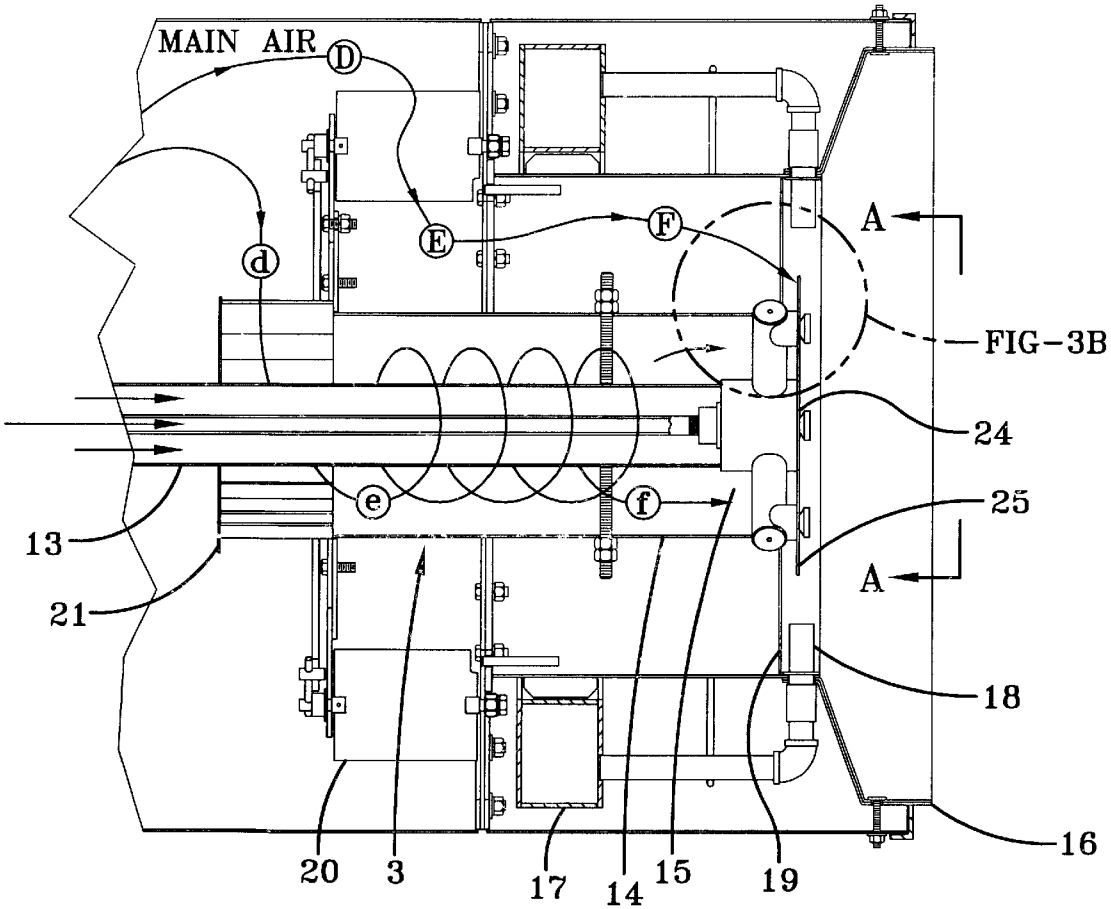

Positioning of the propane nozzle 24 in the burner nose 3 like with the oil nozzles 22, 23, is critical in achieving flame stability, The axial position of the overall propane nozzle assembly is 1⅛ to 1⅞" behind the upstream end of the divergent section or cone segment 16 of the burner nose as shown in FIG. 3, Multiple propane nozzles 24 are required to achieve both stable combustion and maximum fuel burnout. The optimal configuration consists of a center nozzle with 4 to 6 liquid propane holes and either 3 outer nozzles spaced 120° apart or 4 outer nozzles (specifically for large capacity burners with high liquid propane flow rates) evenly spaced 90° apart as shown in FIG. 3). The outer nozzles can also have four to six liquid propane exit holes. The optimum size for each nozzle is in the range of 0.067 to 0.089" in diameter depending upon the desired flow rate. The flame is stabilized on the downstream side of the nozzle deflector plate. The deflector plate 25 serves to divert the secondary air at f and main air at F away from the base of the liquid propane spray pattern, thereby permitting the fuel to vaporize and burn.

When firing liquid propane, the primary air supply is via a separate air blower (the same one used with the low pressure oil atomizer in FIGS. 1 and 5) which supplies approximately 36 osig air pressure. The primary air exits just behind the individual propane nozzles 24 and is diverted radially outward by the nozzle body to ultimately mix and burn with the vaporized propane as seen in FIG. 3A. A hot recirculation zone is thus established downstream of each deflector plate 25/propane nozzle 24 to anchor the flame and resulting in excellent burner stability over a wide range of firing conditions.

Figures 4, 4A:
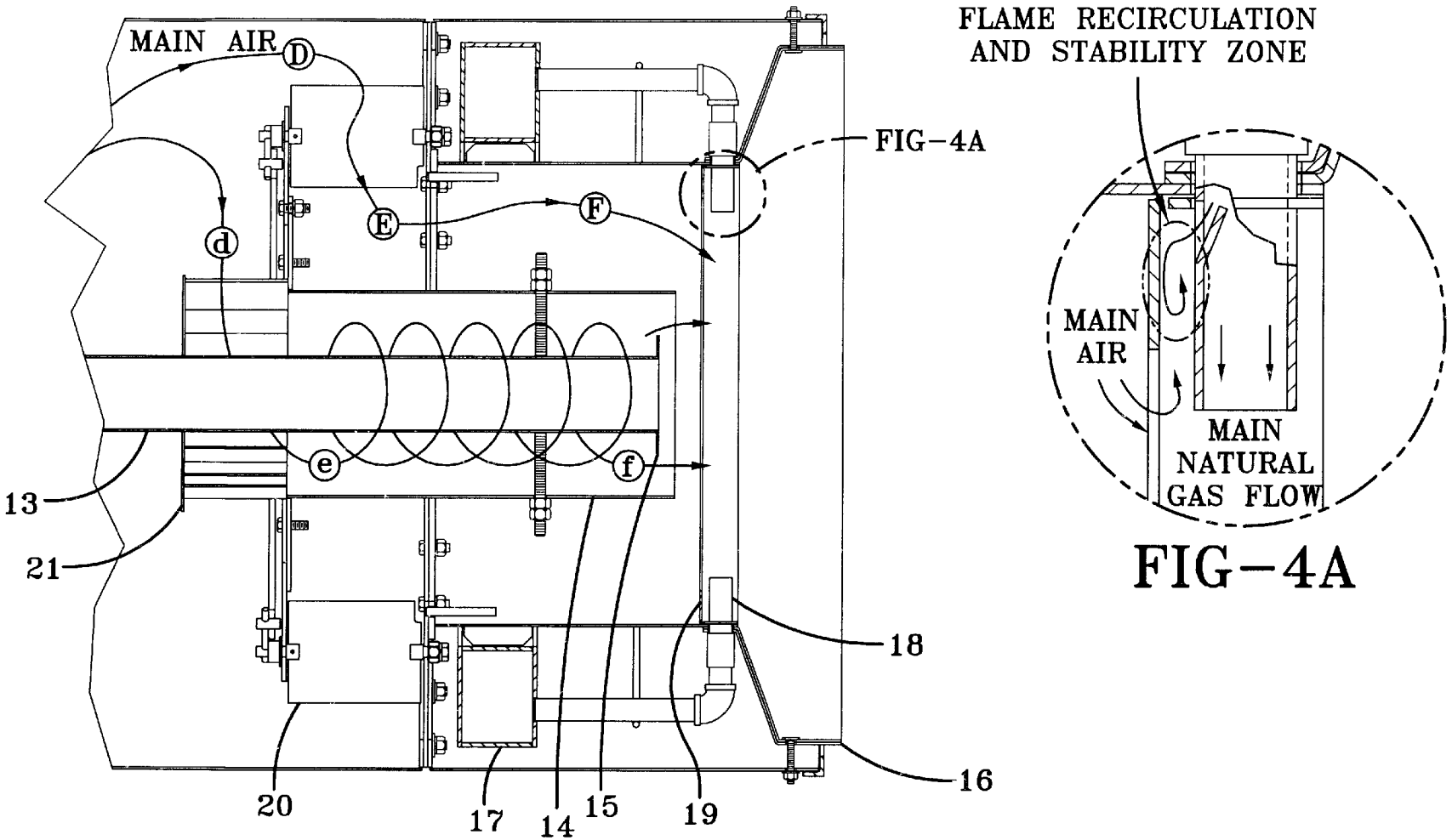
FIGS. 4 and 4A are, respectively, an enlarged partial sectional view of the burner of FIG. 1 when firing "on natural gas" and a further enlarged view of the flame recirculation and stability zone in the circular area of FIG. 4.

When firing natural gas as seen in FIGS. 4 and 4A, the flame is stabilized on the choke ring gutter 19. Stability is accomplished by bleeding a small portion of the main gas flow toward the gutter and mixing it with recirculating main airflow caused by the presence of the gutter 19 as seen in FIG. 4A. The size, or overall inside diameter, of the gutter 19 is as a crucial dimension in relation to the other burner components in establishing a recirculation zone which is sufficient to sustain combustion over a wide range of fuel input firing conditions. Of course, that dimension will vary depending upon burner size but its selection will be within the skill of those in the art in light of the foregoing.

The thus-described burner unit 10 has been found to provide lower CO emissions while firing on oil and have improved flame stability on natural gas, oil and liquid propane. The unique location of the parts provides faster mixing with improved combustion intensity. In addition, the design allows for modular manufacturing of the components.

The foregoing disclosure has been set forth merely to illustrate the invention and is not intended to be limiting.

Since modifications of the disclosed embodiments incorporating the spirit and substance of the invention may occur to persons skilled in the art, the invention should be construed to include everything within the scope of the appended claims and equivalents thereof.

What is claimed is:

1. A combination burner for selectively firing on at least one of oil, natural gas and liquid propane, comprising:

a first section in which primary and secondary air tubes are coaxially arranged and operatively associated with a main combustion air supplying means for supplying main combustion air;

a second section removably joinable to the first section and into which the primary and secondary air tubes extend;

a secondary air spin vane rack at a center of the burner operatively associated upstream of the secondary air tube in the first section;

an adjustable spin rack located radially outwardly of the secondary air tube in the first section for selectively spinning the main combustion air for flame adjustability;

a tertiary air tube located in the second section and extending coaxially with the primary and secondary air tubes;

a cone segment operatively arranged adjacent the tertiary air tube;

an air diverter operatively arranged at a downstream end of the primary air tube; and an air atomizer, the air atomizer further comprising one of a low pressure atomizer and a compressed air atomizer at the downstream end of the primary air tube.

2. The burner according to claim 1, wherein the second section further comprises a nozzle assembly having a plurality of natural gas nozzles located at a downstream end of the tertiary air tube and upstream of the cone segment, said natural gas nozzles extending radially inward.

3. The burner according to claim 2, further including a propane nozzle assembly comprising a center nozzle having between four to six propane holes, and at least three evenly disposed outer nozzles having between four to six propane holes.

4. The burner according to claim 2, wherein a deflector plate is operatively associated with each of the plurality of nozzles.

5. The burner according to claim 3, wherein the nozzles have propane hole diameters in a range from 0.067 inch to 0.089 inch.

6. The burner according to claim 3, wherein the outer nozzles extend radially outwardly from a center line of the second section.

7. A burner according to claim 1, wherein the second section contains a natural gas manifold connected to at least one natural gas nozzle and located between the tertiary air tube and an outer wall of the second section, and a choke ring located in a predetermined position relative to a plane of the at least one natural gas nozzle to provide a flame stability point when firing natural gas.

8. The burner according to claim 1, wherein the air atomizer has a diverging end portion which extends downstream of the primary air tube.

9. The burner according to claim 1, further including means to introduce a primary airflow into the primary tube at a desired location via the main combustion air supplying means without requiring an additional blower.

10. The burner according to claim 9, wherein the primary airflow is subjected to a spinning with a fixed swirl number to enhance a low pressure stability zone and eliminate large droplets of oil overspray when the burner is firing on oil.

11. The burner according to claim 1, wherein the compressed air atomizer is configured with a tip having an angle of divergence ($\alpha$) of between 20° and 35°.

12. The burner according to claim 1, wherein an oil atomizer is located about 3/16" forward of the primary air tube, the primary air tube is located about 1" upstream of the secondary air tube, and the secondary air tube is located 1½" upstream of a choke ring gutter.

13. The burner according to claim 1, wherein the compressed air atomizer is configured with a tip having an angle of divergence ($\alpha$) sufficient to establish a stable oil flame.

14. A combination burner for selectively firing on at least one of oil, natural gas and liquid propane, comprising:

a first section in which primary and secondary air tubes are coaxially arranged and operatively associated with a main combustion air supplying means for supplying main combustion air;

a second section adjacent to and downstream from the first section into which the primary and secondary air tubes extend;

a secondary air spin vane rack at a center of the burner operatively associated upstream of the secondary air tube in the first section;

an adjustable spin rack located radially outwardly of the secondary air tube in the first section for selectively spinning the main combustion air for flame adjustability;

a tertiary air tube located in the second section and extending coaxially with the primary and secondary air tubes;

a cone segment operatively arranged adjacent the tertiary air tube;

an air diverter operatively arranged at a downstream end of the primary air tube; and an air atomizer, the air atomizer further comprising one of a low pressure atomizer and a compressed air atomizer at the downstream end of the primary air tube.

* * * * *